US010441497B2

(12) United States Patent
Yoshida et al.

(10) Patent No.: US 10,441,497 B2
(45) Date of Patent: Oct. 15, 2019

(54) CHAIR-TYPE MASSAGE MACHINE

(71) Applicant: FUJI MEDICAL INSTRUMENTS MFG. CO., LTD., Osaka-shi, Osaka (JP)

(72) Inventors: Toshihisa Yoshida, Osaka (JP); Hironori Yasuda, Osaka (JP)

(73) Assignee: FUJI MEDICAL INSTRUMENTS MFG. CO., LTD., Osaka (JP)

( * ) Notice: Subject to any disclaimer, the term of this patent is extended or adjusted under 35 U.S.C. 154(b) by 933 days.

(21) Appl. No.: 15/008,315

(22) Filed: Jan. 27, 2016

(65) Prior Publication Data

US 2016/0270540 A1 Sep. 22, 2016

(30) Foreign Application Priority Data

Mar. 19, 2015 (JP) ..... 2015-056081

(51) Int. Cl.

*A61H 9/00* (2006.01)
*A61H 23/00* (2006.01)
*A61H 23/02* (2006.01)

(52) U.S. Cl.

CPC ..... *A61H 9/0078* (2013.01); *A61H 23/0263* (2013.01); *A61H 2201/0149* (2013.01);
(Continued)

(58) Field of Classification Search

CPC ..... A61H 9/0078; A61H 2201/1638; A61H 2201/0228; A61H 2201/0149; A61H 2201/0207; A61H 2205/06

See application file for complete search history.

(56) References Cited

U.S. PATENT DOCUMENTS 4,191,177 A * 3/1980 Abbott ..... A61H 1/00 601/125
2005/0203445 A1* 9/2005 Tsai ..... A61H 15/02 601/15

(Continued)

FOREIGN PATENT DOCUMENTS

JP 2005-177279 A 7/2005
JP 2010-046449 A 3/2010

(Continued)

OTHER PUBLICATIONS

CNIPA, First Office Action dated Oct. 31, 2018 in Chinese Patent Application No. 20160051595.2, 9 pages with English translation.

(Continued)

*Primary Examiner* — Timothy A Stanis
(74) *Attorney, Agent, or Firm* — Masuvalley & Partners

(57) ABSTRACT

The armrest portion 1 of a chair-type massage machine includes: an inner divided portion 11 standing outside of a seat portion; an outer divided portion 12 standing outside of the inner divided portion 11; a treating portion 13 provided at at least one of an outer surface of the inner divided portion 11 or an inner surface of the outer divided portion 12; a rotation shaft 14 provided at an front end side of the inner divided portion 11 and the outer divided portion 12; and a restricting portion 15 for restricting an operation range of at least one of either the inner divided portion 11 or the outer divided portion 12, wherein the inner divided portion 11 and the outer divided portion 12 are openable and closable in right and left directions of a person to be treated by using the rotation shaft 14 as a fulcrum.

8 Claims, 6 Drawing Sheets

(52) U.S. Cl.
CPC ..... *A61H 2201/0161* (2013.01); *A61H 2201/0207* (2013.01); *A61H 2201/0228* (2013.01); *A61H 2201/1638* (2013.01); *A61H 2205/06* (2013.01)

(56) References Cited

U.S. PATENT DOCUMENTS

2006/0142676 A1* 6/2006 Fujii ..... A61H 9/0078 601/98
2007/0273187 A1* 11/2007 Tanizawa ..... A61H 9/0078 297/217.3
2007/0287941 A1* 12/2007 Yoda ..... A61H 9/0078 601/151
2010/0042027 A1* 2/2010 Hirata ..... A61F 5/05816 601/151
2010/0312155 A1* 12/2010 Fukuyama ..... A61H 9/0078 601/98
2014/0142478 A1* 5/2014 Malaviya ..... A61H 15/0078 601/115
2014/0343467 A1* 11/2014 Fukuyama ..... A61H 7/007 601/98

FOREIGN PATENT DOCUMENTS

JP 2013-022404 A 2/2013
JP 2015-002902 A 1/2015

OTHER PUBLICATIONS

Japan Patent Office, Notice of Rejection, drafting date Sep. 20, 2018 in Japanese Patent Application No. 2015-056081, total 5 pages including English translation.

* cited by examiner

CHAIR-TYPE MASSAGE MACHINE

This application claims priority under 35 U.S.C. § 119 to Japanese patent application Serial No. 2015-056081, filed Mar. 19, 2015, which is incorporated herein by reference in its entirety.

FIELD OF THE INVENTION

The present invention pertains to a chair-type massage machine. The chair-type massage machine includes a seat portion on which a person to be treated sits, a backrest portion against which the person to be treated can recline, and an armrest portion which is capable of treating the arm portion of the person to be treated.

BACKGROUND OF THE INVENTION

Conventionally, a chair-type massage machine having a backrest portion being capable of reclining, a seat portion, and an armrest portion is widely known. Such a chair-type massage machine is provided with a kneading ball actuated by electric power for massaging the lower back portion, the back portion, the neck portion, the seat portion, and the arm portion of the human body and/or a bag body which expands or contract by a change of air pressure using compressed air.

For example, a seat portion to be seated and an armrest portion provided at the both sides of the seat portion for treating the both arms of a person to be treated are disclosed. It is also disclosed as one aspect that an inner erection wall and an outer erection wall composing the armrest portion are provided with keeping a predetermined space from each other.

SUMMARY OF THE INVENTION

One embodiment of the present invention is a chair-type massage machine having an armrest portion. The armrest portion includes:

- an inner divided portion standing outside of a seat portion on which a person to be treated sits;
- an outer divided portion standing outside of the inner divided portion;
- a treating portion provided at at least one of either an outer surface of the inner divided portion or an inner surface of the outer divided portion;
- a rotation shaft provided at an front end side of the inner divided portion and the outer divided portion; and
- a restricting portion for restricting an operation range of at least one of either the inner divided portion or the outer divided portion,
- wherein the inner divided portion and the outer divided portion are openable and closable in right and left directions of the person to be treated by using the rotation shaft as a fulcrum.

DETAILED DESCRIPTION OF THE PREFERRED EMBODIMENTS

Figure 1:
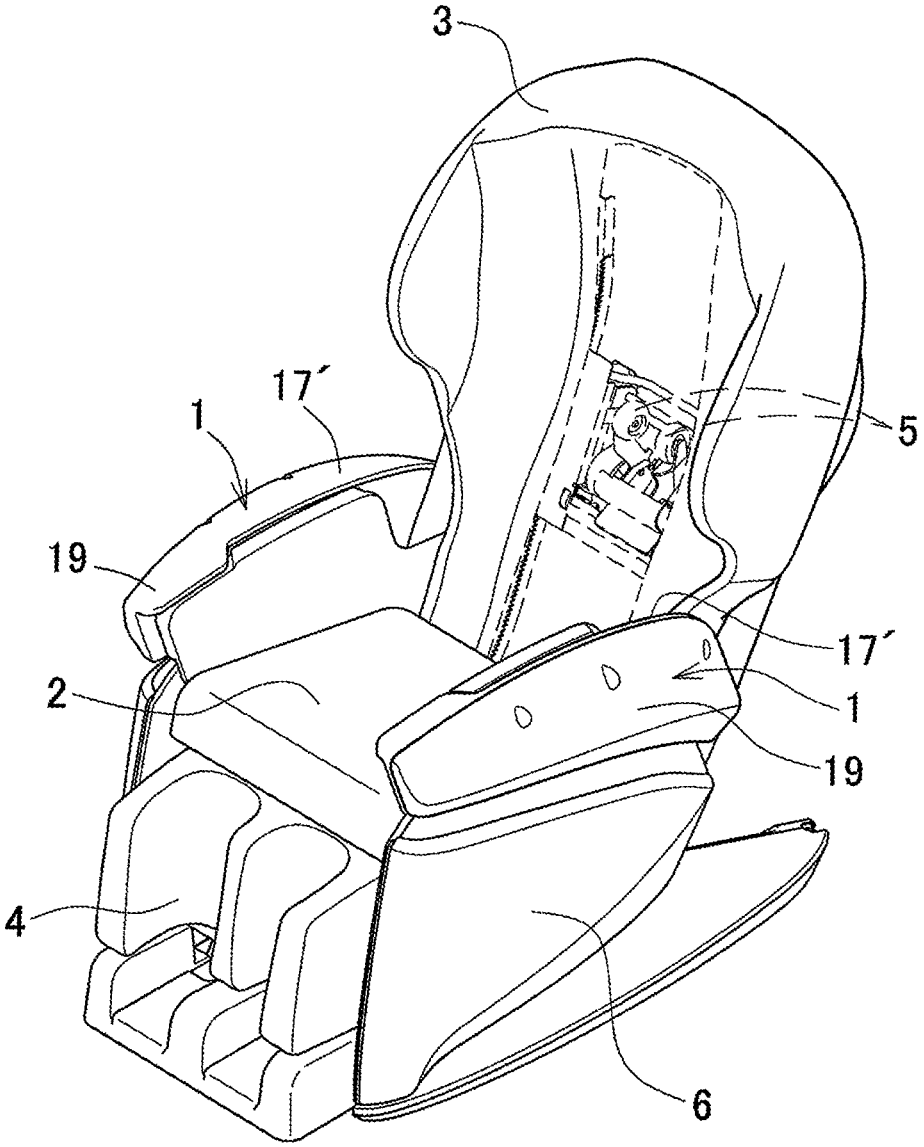
FIG. 1 is an entire perspective view illustrating one embodiment of a chair-type massage machine of the present invention.

A chair-type massage machine of the present invention will be explained in detail below based on an embodiment illustrated in the figures. FIG. 1 is an entire perspective view illustrating one embodiment of a chair-type massage machine of the present invention. FIGS. 2 through 5 illustrate an inner divided portion and an outer divided portion which are taking an open position or a close position after an exterior cover has been removed from a left armrest portion of the chair-type massage machine of the present invention for making the inside of the left armrest portion visible. Also, the front and back directions, the right and left directions, and the up and down directions in the explanation are based on a person to be treated who sits on a seat portion. The right side of FIGS. 2 and 3 corresponds to the outside (the left direction) of the person to be treated. The near side of the paper surface of FIGS. 2 and 3 corresponds to the upward direction of the person to be treated, and the back side of the paper surface of FIGS. 2 and 3 corresponds to the downward direction of the person to be treated. The upper side of FIGS. 2 and 3 corresponds to the back side of the person to be treated, and the lower side of FIGS. 2 and 3 corresponds to the front side of the person to be treated.

As shown in FIG. 1, the chair-type massage machine of the present invention includes a seat portion 2, an armrest portion 1 disposed outside of the right and left sides of the seat portion 2, a backrest portion 3 provided at the rear side of the seat portion 2, and a footrest portion 4 disposed closely to the seat portion 2 in the front direction of the armrest portion 1 and the seat portion 2, that is, in the direction where a person to be treated is facing when the person sits on the seat portion 2. Also, a base portion 6 as the base of the armrest portion 1, the seat portion 2, the backrest portion 3, and the footrest portion 4 is grounded.

The backrest portion 3 has a back portion treatment member 5 for doing a massage such as a press against the head portion, the neck portion, the back portion, the seat portion, and the like of a person to be treated. The back portion treatment member 5 can be moved up and down on the center part of the backrest portion 3 by the electric power with using a control device such as a remote control device which can be operated by the person to be treated at hand. It is possible to control a spot of massaging, the strength of massaging, a way of massaging, a treating period of massaging, and the like by various built-in programs in the control device.

Also, a treatment member such as an air bag (not shown) is provided at the footrest portion 4. The treatment member provided at the footrest portion 4 can massage both of thighs, both of shins, both of legs, and the like in combination, with working in conjunction with the back portion treatment member 5 provided at the backrest portion 3 or independently, by being controlled by the various built-in programs in the control device.

Since the footrest portion 4 is provided at the front side of the seat portion 2, the footrest portion 4 can be pivoted against the seat portion 2 automatically or manually by being controlled by the various built-in programs in the control device. For example, when the backrest portion 3 is standing, as shown in FIG. 1, the footrest portion 4 can be substantially perpendicular to the seat portion 2. When the backrest portion 3 is reclining, the footrest portion 4 can be positioned to be substantially perpendicular to the seat portion 2 or can be positioned to be substantially even with the seat portion 2.

FIGS. 2 through 6 illustrates a state where only the armrest portion 1 is extracted from the state of FIG. 1 and the outmost exterior cover 19 is removed. In the state of FIGS. 2 through 6, the armrest portion 1 is provided with an inner divided portion 11 standing outside of the seat portion 2 and an outer divided portion 12 standing outside of the inner divided portion 11. The outer divided portion 12 moves close to or away from the fixed inner divided portion 11 so as to open or close the inner divided portion 11 and the outer divided portion 12. The arm portion of a person to be treated can be treated by inserting the arm portion into the space which results from the outer divided portion 12 moving away from the inner divided portion 11. Incidentally, FIGS. 2 through 6 illustrate the left armrest portion 1 of the chair-type massage machine. The right armrest portion 1 is omitted because the right armrest portion 1 has the symmetrical structure with the left armrest portion 1.

The inner divided portion 11 is a member standing outside of the seat portion on which a person to be treater sits. In the present embodiment, the inner divided portion 11 is provided with a substantially board-like inner base portion 11*a* which stands substantially vertically toward the seat portion 2 and is along with the side of the seat portion 2, a rotation shaft support portion 11*b* provided at the front side of the inner base portion 11*a* and extending toward the outside of the inner base portion 11*a* for gripping the rotation shaft 14, and a restricting portion support portion 11*c* provided at the rear side of the rotation shaft support portion 11*b* and extending toward the outside of the inner base portion 11*a* for gripping the restricting portion 15.

Also, the inner divided portion 11 has a lower resting portion 18 provided at the lower part of the inner base portion 11*a* along the longitudinal direction of the inner base portion 11*a* and extending toward the outside of the inner divided portion 11*a*. The lower resting portion 18 is the place on which a person to be treated can put the arm when the arm is treated, and the person can get the arm treated without feeling tired even if the treatment takes a long time.

Incidentally, in the present embodiment, the lower resting portion 18 is provided only at the inner divided portion 11; however, in another embodiment, the lower resting portion 18 can be provided only at the lower part of an outer base portion 12*a* of the outer divided portion 12, or at both of the lower part of the inner base portion 11*a* and the lower part of the outer base portion 12*a*.

In addition, the lower resting portion 18 may have a built-in heating portion (not shown) for heating the lower resting portion 18. For example, as the heating portion, a heating wire such as a Nichrome™ wire which generates heat by the electric current supplied by the electric supply can be used. When the chair-type massage machine is used in the cold season, the heat portion can be used for heating the forearm such as the hand portion and the arm portion of a person to be treated. It is preferable that a switch for heating, which can be operated by the person to be treated at hand, is provided at the control device and the like such as a remote control device.

A part of the upper part of the inner base portion 11*a* of the inner divided portion 11 is an upper resting portion 17 which has a predetermined width in the right and left directions and is substantially flat. When a person to be treated does not get the arm treated, that is, when the inner divided portion 11 and the outer divided portion 12 are closed, the person can put the arm on the upper resting portion 17 which is the upper part of the inner base portion 11*a* and an upper resting portion 17' which is the upper part of the exterior cover 19. Even when the inner divided portion 11 and the outer divided portion 12 are closed, a person to be treated still has a place where the person can put the arm on. This means that it is possible to make the width of the chair-type massage machine in the right and left directions smaller, while ensuring the place where the arm can be put. Therefore, the chair-type massage machine can be smoothly carried into or out from a front door and the like which are relatively narrow.

The outer divided portion 12 is a member standing outside of the inner divided portion 11. In the present embodiment, the outer divided portion 12 is provided with a substantially board-like outer base portion 12*a* which is substantially parallel to the inner base portion 11*a*. A rotation shaft support portion open hole 12*b* for the rotation shaft support portion 11*b* going through and a restricting support portion open hole 12*c* for the restricting portion support portion 11*c* going through are drilled in the front side of the outer base portion 12*a*.

Also, the outer divided portion 12 is provided with two rotation shaft insertion portions 12*d* which are attached so as to extend toward the outside of the outer base portion 12*a* and through which the rotation shaft 14 is inserted. By this structure, the outer divided portion 12 can move close to or away from the inner divided portion 11 by using the rotation shaft 14 as the base point so that the inner divided portion 11 and the outer divided portion 12 are openable and closable. Also, at the two rotation shaft insertion portions 12*d*, a biasing means hold portion 12*e* which projects toward the outside of the outer base portion 12*a* and to which one end of an elastic spring, that is a biasing means 16, is attached is provided.

The exterior cover 19 shown in FIG. 1 is attached to the outside of the outer divided portion 12 of FIGS. 2 through 6 so as to cover the rotation shaft 14 and the restricting portion 15. The upper part of the exterior cover 19 is the upper resting portion 17' which has the predetermined width in the right and left directions and is substantially flat. When a person to be treated does not get the arm treated, that is, when the inner divided portion 11 and the outer divided portion 12 are closed, the person can put the arm on the upper resting portion 17 which is the upper part of the inner base portion 11*a* and the upper resting portion 17' which is the upper part of the exterior cover 19. Incidentally, in the present embodiment, the upper resting portions 17, 17' are provided at a part of the upper part of the inner base portion 11*a* and the upper part of the exterior cover 19; however, the upper resting portion can be provided at at least either the upper part of the inner base portion 11*a* or the upper part of the exterior cover 19. Further, the upper resting portions 17, 17' can take not only the flat shape but also a curved shape.

As shown in FIGS. 2 through 6, a treatment portion 13, which is a member for massaging the hand portion and the arm portion of a person to be treated, is fixedly installed at an outer surface of the inner divided portion 11 and an inner surface of the outer divided portion 12, that is, at the surfaces of the inner divided portion 11 and the surface of the outer divided portion 12 which face each other. In the present embodiment, the treatment portion 13 is configured as an air bag which is capable of expanding and contracting by being connected to an air supply and exhaust device (not shown) through a tube (not shown) having a cylindrical shape and the like. Two treatment portions 13 are arranged side by side on each of the inner divided portion 11 and the outer divided portion 12 in the direction from the front side to the rear side. In the present embodiment, two treatment portions 13 are arranged side by side on each of the inner divided portion 11 and the outer divided portion 12 in the direction from the front side to the rear side; however, in another embodiment, a single, oblong air bag can be fixedly installed or the plural number of air bags, such as the number of three, four, five and six, can be arranged side by side in the direction from the front side to the rear side. When two or more treatment members 13 are arranged side by side, it is possible to give a complex and effective massage to the hand portion and the arm portion of a person to be treated.

Also, in the present embodiment, as the treatment portion 3, an air bag which is capable of expanding and contracting is provided; however, in another embodiment, it is possible to use a vibrator giving a vibration to a person to be treated by having an eccentric motor actuated by the electric power. Also, it is possible to use a pair of treatment members which have a shape such as a spherical shape such as the back portion treatment member 5, a spheroidal shape, and a solid shape composed of a closed surface and which are actuated by the electric power in the same manner as the vibrator for pressing force on the forearm portion such as the hand portion, the arm portion, and the like. Also, it is possible to use an air bag being capable of repeatedly expanding and contracting, a vibrator giving a vibration to a person to be treated, and a treatment member pressing force on the person to be treated, independently. Also, two or more of the air bag, the vibrator, and the treatment member can be combined to be used together.

As shown in FIGS. 2 through 5, the rotation shaft 14 is a rod-shaped member provided at a front end side of the inner divided portion 11 and the outer divided portion 12. In the present embodiment, the rotation shaft 14 stands in the up and down directions, and is gripped by the two rotation shaft support portions 11*b*. Also, the rotation shaft 14 is inserted through the holes having a substantially circle shape drilled on the rotation shaft insertion portions 12*d*. Therefore, the outer divided portion 12 can be openable and closable toward the inner divided portion 11 on the rotation shaft 14.

As shown in FIGS. 2 through 5, the restricting portion 15 is a member for restricting an operation range of at least one of either the inner divided portion 11 or the outer divided portion 12. In the present embodiment, the restricting portion 15 stands in the up and down directions, and is gripped by the two restricting portion support portions 11*c*. Also, the restricting portion 15 is provided so as to be positioned at the outside of the outer divided portion 12. By having this structure, when the outer divided portion 12 moves in the open direction from the inner divided portion 11 on the rotation shaft 14, the outer divided portion 12 eventually comes into contact with the restricting portion 15 and the outer divided portion 12 is not allowed to move further outside by the restricting portion 15. Therefore, there is no possibility that the outer divided portion 12 bumps against a piece of furniture positioned next to the chair-type massage machine and/or a person who happens to be next to the chair-type massage machine. Consequently, there is no chance to hurt the furniture and/or the people. It is preferable that an angle at which the inner divided portion 11 and the outer divided portion 12 are allowed to be open and close by the restricting portion 15 is equal or more than 0 degree to equal or less than 40 degrees. It is more preferably that the angle is equal or more than 0 degree to equal or less than 20 degrees. It is the most preferable that the angle is equal or more than 0 degree to equal or less than 10 degrees. Such an open/close angle can be achieved by optionally adjusting the position of the restricting portion 15. By setting the angle at which the inner divided portion 11 and the outer divided portion 12 are open and close in such a range, there is no possibility that the outer divided portion 12 is open too much into the right and left directions of the chair-type massage machine. Since the outer divided portion 12 does not bump against furniture and the like, the chair-type massage machine can be easily installed in a house.

Also, the restricting portion 15 has a restricting portion recess 15*a* recessed inside the peripheral side surface. Since the other end of the elastic spring, that is the biasing means 16, is fitted into the restricting portion recess 15*a*, the other end of the biasing means 16 does not move up and down along the restricting portion 15, thereby making the biasing direction of the biasing means 16 constant.

As shown in FIGS. 2 through 5, one end of the biasing means 16 is provided at the outer divided portion 12 and the other end of the biasing means 16 is provided at the restricting portion 15. The biasing means 16 is a member biasing the inner divided portion 11 and the outer divided portion toward a close direction. In the present embodiment, the biasing means 16 is a coil-shaped elastic spring, and one end and the other end of the biasing means 16 have a U-shaped hook. One end of the biasing means 16 is latched together with the biasing means hold portion 12*e* which is a part of the outer divided portion 12, and the other end of the biasing means 16 is latched together with the restricting portion recess 15*a* of the restricting portion 15.

Figure 2:
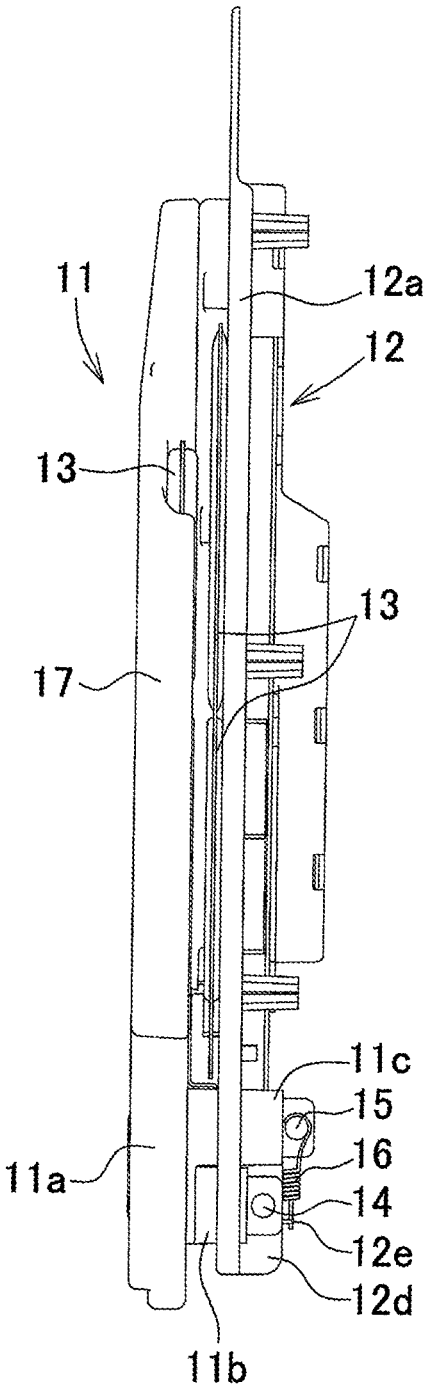
FIG. 2 is a plane view illustrating a left armrest portion of the chair-type massage machine of the present invention, the left armrest portion taking its close position after an exterior cover has been removed from the left armrest portion.
Figure 3:
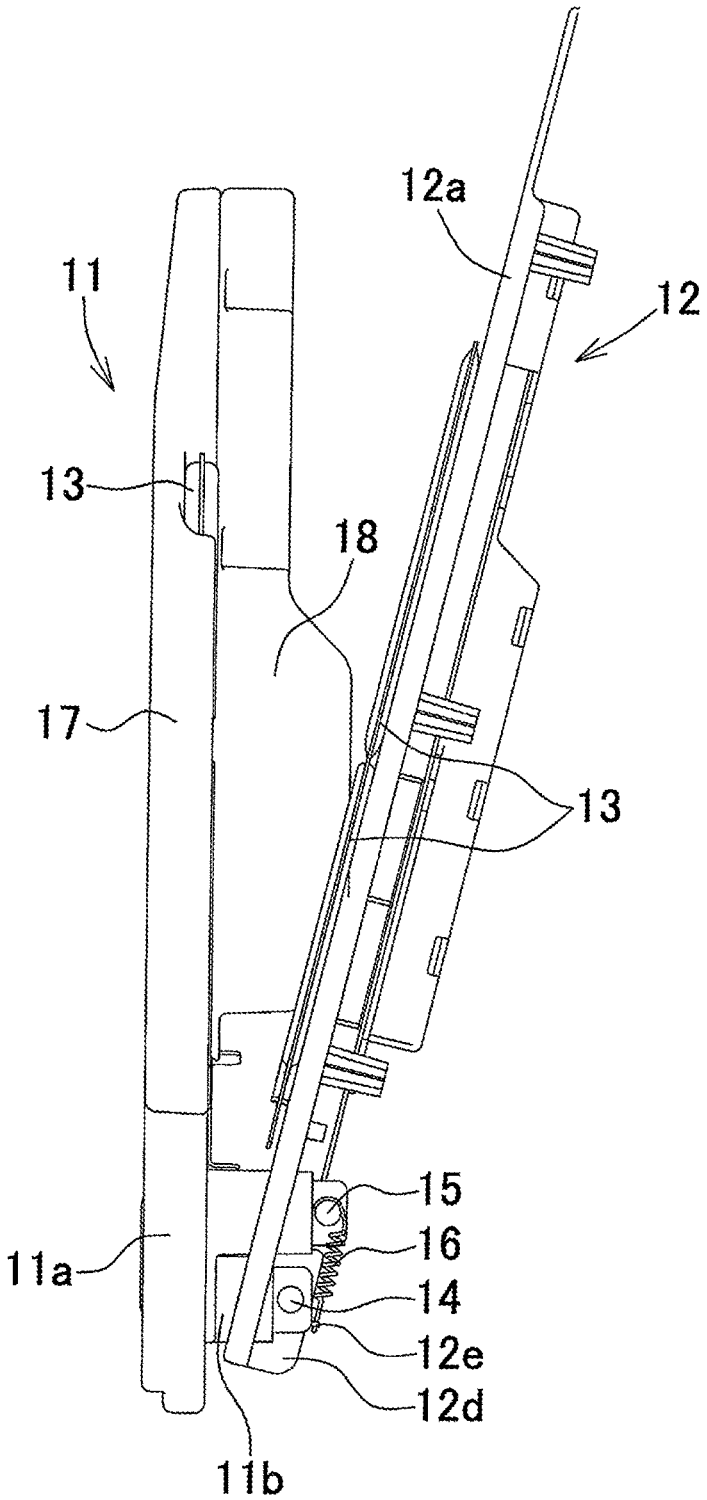
FIG. 3 a plane view illustrating a left armrest portion of the chair-type massage machine of the present invention, the left armrest portion taking its open position after an exterior cover has been removed from the left armrest portion.
Figure 4:
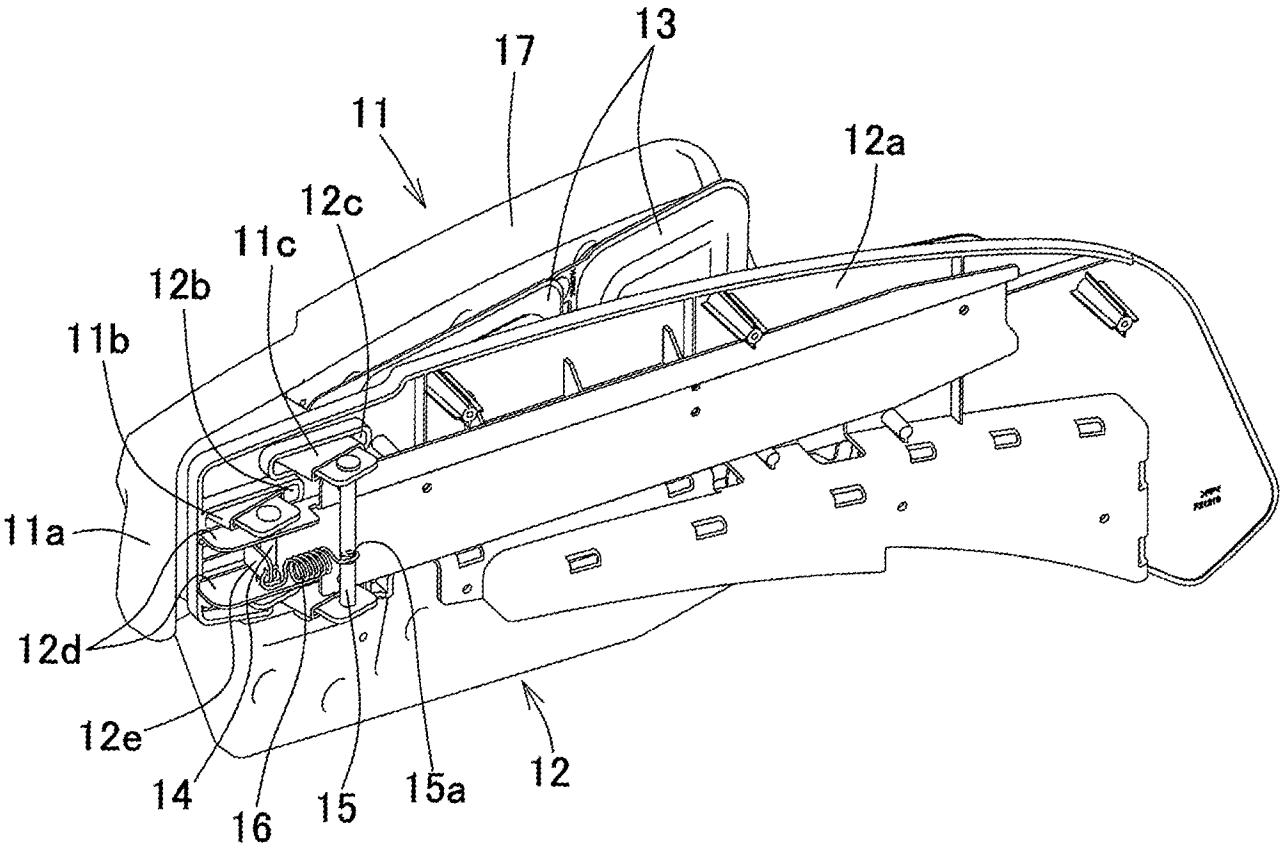
FIG. 4 is a perspective view of a left armrest portion of the chair-type massage machine of the present invention, the left armrest portion being looked down from the obliquely front direction after an exterior cover has been removed from the left armrest portion.
Figure 5:
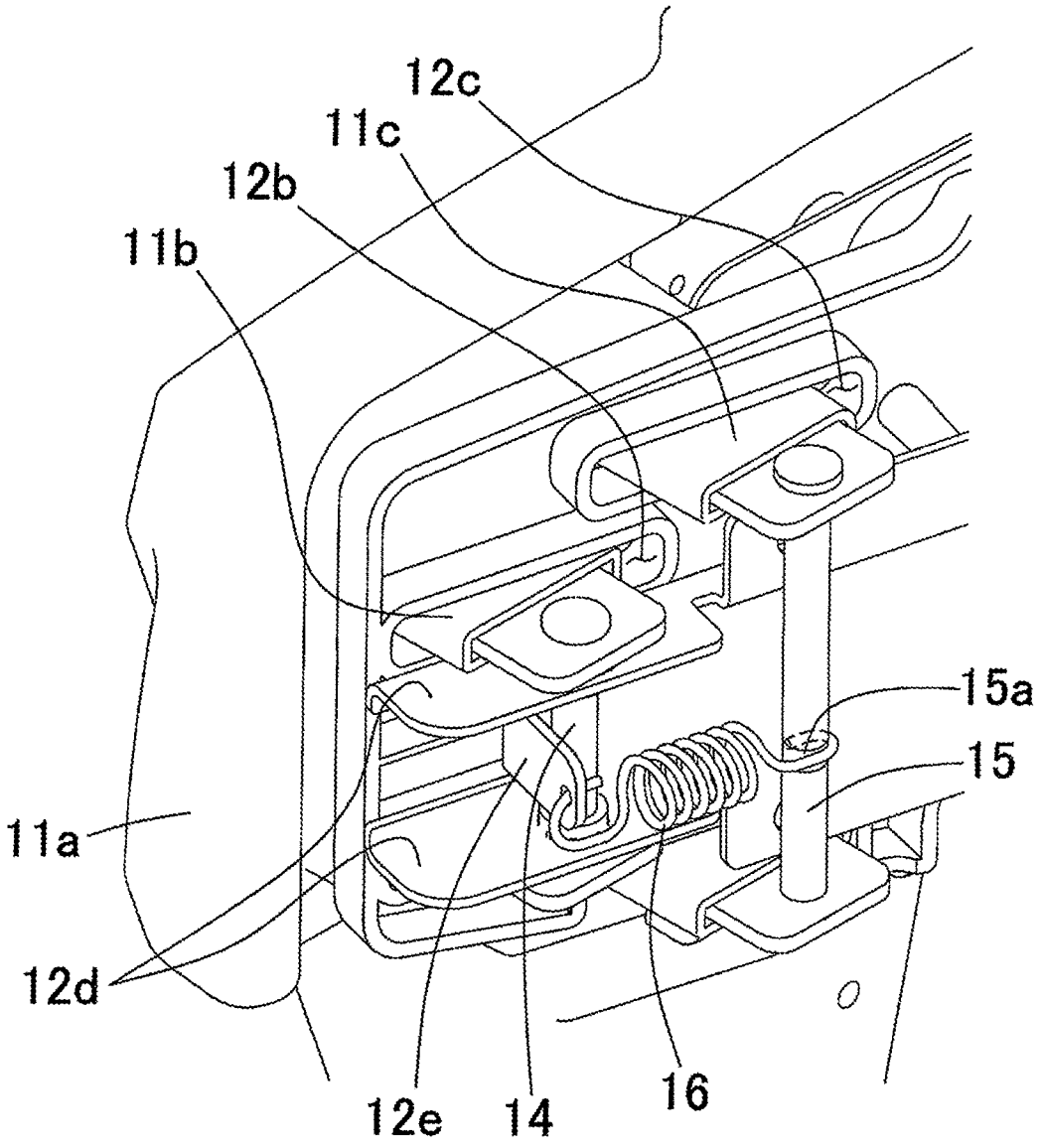
FIG. 5 is a partial enlarged view enlarging the periphery of a rotation shaft and a restricting portion of FIG. 4.
Figure 6:
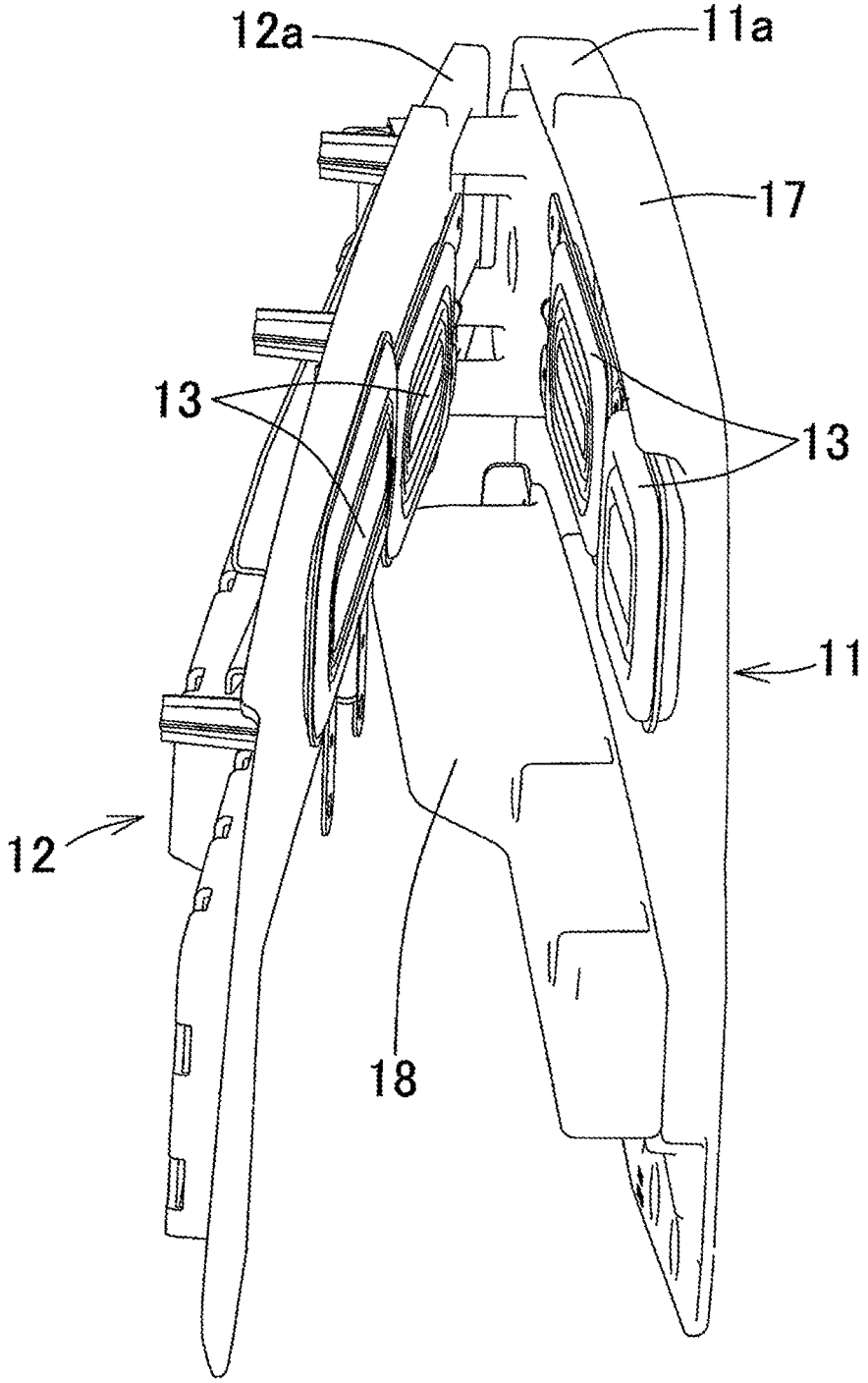
FIG. 6 is a perspective view of a left armrest portion of the chair-type massage machine of the present invention, the left armrest portion being looked down from the rear side after an exterior cover has been removed from the left armrest portion.

When the state of FIG. 2 where the inner divided portion 11 and the outer divided portion 12 are closed, is changed to the state of FIG. 3 where the inner divided portion 11 and the outer divided portion 12 are open, as shown in FIG. 4, the biasing means hold portion 12*e* comes to close to the inner divided portion 11 because the biasing means hold portion 12*e* is positioned closer to the front side than the rotation shaft 14.

Meanwhile, the restricting portion 15 does not move. Therefore, since the distance between the biasing means hold portion 12*e* and the restricting portion 15 is increased, the elastic spring as the biasing means 16 will be extended against its biasing force. Consequently, the biasing force of the elastic spring as the biasing means 16 functions so that the outer divided portion 12 moves to the direction where the distance between the biasing means hold portion 12*e* and the restricting portion 15 is decreased, that is, the direction where the inner divided portion 11 and the outer divided portion 12 is closed.

What is claimed is:

1. A chair-type massage machine having an armrest portion, the armrest portion comprising:

an inner divided portion standing outside of a seat portion configured to allow a person to sit and receive treatment;

an outer divided portion standing outside of the inner divided portion;

a plurality of treating portions provided at at least one of either an outer surface of the inner divided portion or an inner surface of the outer divided portion;

a rotation shaft provided at a front end side of the inner divided portion and the outer divided portion; and a restricting portion for restricting an operation range of at least one of either the inner divided portion or the outer divided portion, wherein the restricting portion is a shaft which is gripped by a plurality of restricting portion support portions extending toward the outside of the inner divided portion;

wherein the inner divided portion and the outer divided portion are openable and closable in right and left directions of the person to be treated by using the rotation shaft as a fulcrum.

2. The chair-type massage machine according to claim 1, further comprising a biasing means, wherein one end of the biasing means is provided at the outer divided portion and the other end is provided at the restricting portion, and the biasing means biases the inner divided portion and the outer divided portion toward a closed direction.

3. The chair-type massage machine according to claim 1, comprising an upper resting portion being capable of putting a forearm on, wherein the upper resting portion is provided at at least one of either an upper surface of the inner divided portion or an upper surface of the outer divided portion.

4. The chair-type massage machine according to claim 1, wherein the restricting portion is provided at a rear side of the rotation shaft, and the restricting portion is a member which is configured to contact with an outer surface of the outer divided portion.

5. The chair-type massage machine according to claim 1, wherein the plurality of treating portions are continuously provided in a direction from a front end side to a rear end side.

6. The chair-type massage machine according to claim 1, comprising a lower resting portion being capable of putting a forearm on, wherein the lower resting portion is provided at at least one of either a lower portion of the outer surface of the inner divided portion or a lower portion of the inner surface of the outer divided portion.

7. The chair-type massage machine according to claim 1, wherein the treating portion has an air bag being capable of repeating an expansion and a contraction by air.

8. The chair-type massage machine according to claim 1, wherein an angle at which the inner divided portion and the outer divided portion are opened and closed is equal or more than 0 degree to equal or less than 40 degrees.

* * * * *